United States Patent [19]

Yoshizumi

[11] Patent Number: 4,500,762

[45] Date of Patent: Feb. 19, 1985

[54] RESISTOR-TYPE DISCONNECTING SWITCH FOR CIRCUIT BREAKER

[75] Inventor: Toshiaki Yoshizumi, Minoo, Japan

[73] Assignee: Mitsubishi Denki Kabushiki Kaisha, Tokyo, Japan

[21] Appl. No.: 479,072

[22] Filed: Mar. 25, 1983

[30] Foreign Application Priority Data

Mar. 25, 1982 [JP] Japan ..... 57-49610

[51] Int. Cl.[3] ..... H01H 33/16

[52] U.S. Cl. ..... 200/144 AP; 200/148 R

[58] Field of Search ..... 200/144 AP, 149 B, 148 A, 200/149 R, 146 R, 144 R, 148 R

[56] References Cited

U.S. PATENT DOCUMENTS 3,549,841 12/1970 McLoud et al. ..... 200/146 R

OTHER PUBLICATIONS

Interrupting Performance of Capacitive Current by Disconnecting Switch for Gas Insulated Switchgear, by: S. Narimatsu et al., published Jun. 1981, IEEE Transactions on Power Apparatus and Systems, vol. PAS-100, No. 6, pp. 2726-2732.

*Primary Examiner*—A. D. Pellinen
*Assistant Examiner*—Morris Ginsburg
*Attorney, Agent, or Firm*—Wenderoth, Lind & Ponack

[57] ABSTRACT

A disconnecting switch including a hollow cylindrical shield of an electrically conducting material including a circular opening, a spring loaded arcing contact member, a main stationary contact member disposed within the shield to be slightly spaced from the plane of the opening and surround the arcing contact member, and a toroidal electrode disposed in the opening and having a curved surface externally protruding beyond the plane of the opening. The arcing and main contact members are connected to the shield while the electrode is connected to the shield through a resistor. At the open position the arcing contact member slightly protrudes beyond the plane of the opening. At the closed position a movable contact member engages both the main contact member and the arcing contact member at its retroggessing position.

3 Claims, 15 Drawing Figures

RESISTOR-TYPE DISCONNECTING SWITCH FOR CIRCUIT BREAKER

BACKGROUND OF THE INVENTION

This invention relates to gas-filled disconnecting switch which includes a resistor for suppressing an abnormal voltage and is capable of interrupting a loop current.

In electric power substations, the disconnecting switch is normally located adjacent to an associated circuit breaker and is typically used (1) to open and close a line disconnected by the circuit breaker and (2) to switch transmission systems. For the former function (1), the disconnecting switch is operative to open and close an electric line under non-loading conditions and it is known that the restrike of an electric arc is repeated across a pair of opposite contact members of the disconnecting switch to generate sharp so-called disconnecting switch-surges. This is because the disconnecting switch has a switching speed which is relatively low as compared with the switching speed of the circuit breaker. It is also well known to provide the disconnecting switch with a resistor for suppressing such opening and closing surges.

On the other hand, the latter function (2) serves to switch power from one to another of bus bars in the associated substation by use of the disconnecting switch. For example, where a pair of bus bars are connected to a common line through respective disconnecting switches, the operation of switching from one to the other of the bus bars results in the interruption of the so-called loop current which approximates a rated current flowing through a circuit including the pair of disconnecting switches, by utilizing the good interrupting ability exhibited by a sulfur hexafluoride ($SF_6$). This is also well known.

Furthermore both the ability to open and close a line under non-loading conditions and the ability to open and close the loop current as described above are required, in many cases, for a common disconnecting switch to be disposed within a substation.

A conventional disconnecting switch including a resistor for suppressing surges upon opening and closure is disclosed, for example, in Japanese laid-open patent application No. 95,276/1978. According to the cited application, the prior disconnecting switch includes an envelope filled with a sulfur hexafluoride ($SF_6$) gas, an electrically conducting support member extended and sealed through one end of the envelope, and a main stationary contact member and an arcing stationary contact member are coaxially disposed on the support member. Also a hollow cylindrical resistor is disposed on the support member to coaxially surround the main stationary contact member and includes a free end portion terminating at a metallic shield in the form of a semitoroid located above the main stationary contact member and surrounding the arcing stationary contact member. A movable contact member in the form of a hollow cylinder is disposed to oppose to the main and arcing stationary contact members and separably engage them by having one end portion thereof separably sandwiched therebetween.

Upon disengaging the movable contact member from the main and arcing stationary contact members, scores of restruck electric arcs are intermittently caused across the shield and the extremity of the movable contact member, resulting in the occurrence of high sharp surges which are reduced by the hollow cylindrical resistor. This is true in the case of the engagement of the movable contact member with the main and arcing stationary contact members. Also the restruck arc has resulted in damages to the shield.

Furthermore an electric field established adjacent to the cylindrical resistor has abruptly changed immediately after the occurrence of a restruck electric arc as compared with that established before the occurrence of the restruck arc. This has resulted in a rapid increase in electric field intensity from the shield or support member directed to the envelope. Thus, this rapid increase in electric field intensity has progressed with high probability to a short circuit-to-ground fault.

Accordingly, it is an object of the present invention to provide a new and improved disconnecting switch, capable of preventing the shield from being damaged due to a restruck electric arc caused upon the opening and closure thereof, and substantially free from a change in electric field established adjacent a stationary contact side immediately after the occurrence of the restruck electric arc.

SUMMARY OF THE INVENTION

The present invention provides a disconnecting switch having a structure for providing a current through a pair of main contacts which commutates to a pair of arcing contacts and then to a resistor followed by an interruption. The switch comprises an electrically conducting shield including a circular opening, a movable contact member forming one of each of the pairs of main and arcing contacts arranged to be inserted within the shield through the circular opening, the movable contact member including contact portions arranged to engage the other of each of the pairs of main and arcing contacts, the contact portions being located within the shield when the pairs of main and arcing contacts are in the closed position, and a resistive electrode in the form of a toroid disposed between a portion of the shield defining the circular opening of the shield and the movable contact member, the toroid having a curved surface externally protruding beyond the opening, the arrangement being such that, upon the pair of arcing contacts disengaging from each other, the pair of arcing contacts is connected in parallel to a series combination of the resistive electrode and a gap formed between the movable contact member and the resistive electrode.

BRIEF DESCRIPTION OF THE DRAWINGS

The present invention will become more readily apparent from the following detailed description taken in conjunction with the accompanying drawings in which.

DETAILED DESCRIPTION OF THE PREFERRED EMBODIMENT

Figure 1:
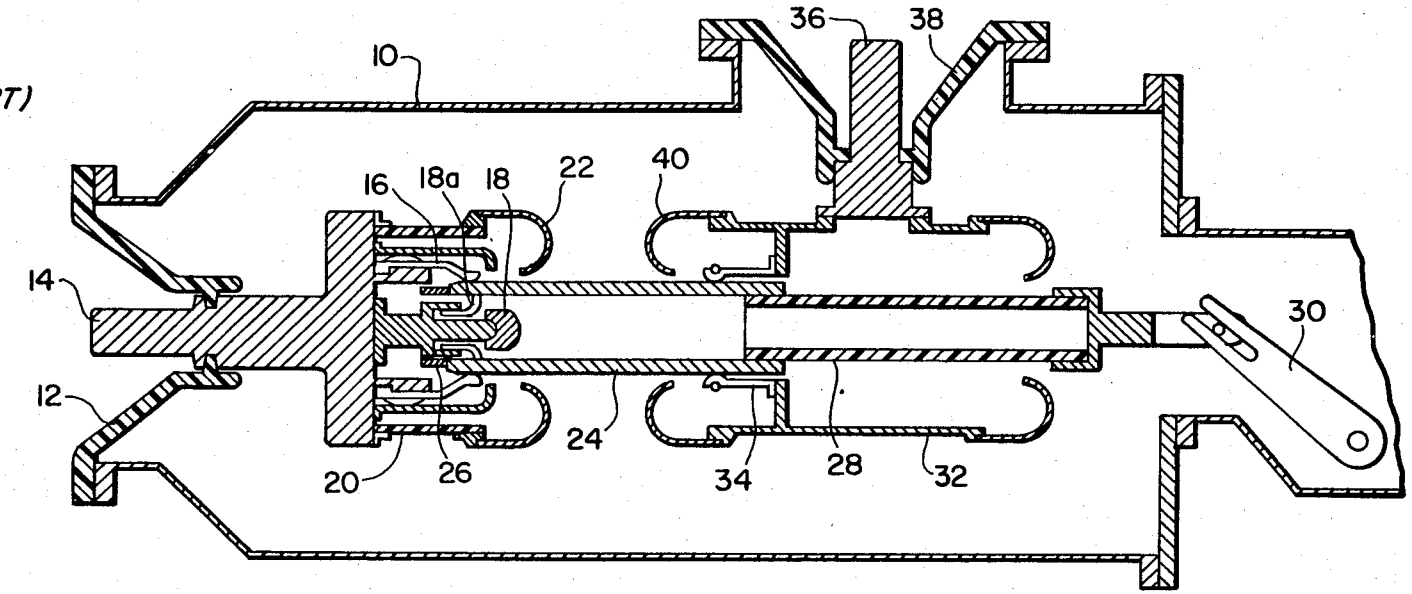
FIG. 1. (PRIOR ART)
FIG. 1 is a longitudinal sectional view of a conventional disconnecting switch illustrated at its closed position, with parts illustrated in elevation.

For a better understanding of the present invention, a conventional disconnecting switch will now be described in conjunction with FIG. 1 of the drawings which is a replica of FIG. 5 of Japanese laid-open patent application No. 95,276/1978. The arrangement illustrated comprises an envelope 10 in the form of a hollow cylinder including one open end, in this case, a left-hand open end as viewed in FIG. 1, hermetically enclosed with an electrically insulating cover 12 and a metallic support member 14 coaxially disposed within the envelope 10 adjacent to the enclosed end portion by having its support rod extended and sealed through the electrically insulating cover 12 to lie on the longitudinal axis of the envelope 10 and its support disc integrally connected to that end of the supporting rod disposed within the envelope 10 to be perpendicular to the longitudinal axis. A main stationary contact member 16 in the shape of a tulip is disposed concentrically on the upper surface as viewed in FIG. 1 of the support disc and surrounds an arcing stationary contact member 18. Contact member 18 is centrally disposed on the upper surface of the support disc and somewhat extends beyond the free end of the main stationary contact member 16. The arcing stationary contact member 18 is connected to the main stationary contact member 16 through a finger-shaped contact member 18*a*. Then a hollow cylindrical member 20 formed of an electrically resistant material is disposed on the upper surface of the support disc to coaxially surround the main stationary contact member 16 and provided on the extremity thereof with an annular metallic shield 22. The shield 22 has a radially inwardly periphery radially inwardly curved into a semi-toroid having a relatively large diameter and located above the upper end of the main stationary contact member 16. The semi-toroidal portion of the shield 22 surrounds the upper portion of the arcing stationary contact member 18 and the radially inward periphery thereof protrudes beyond the latter.

In this way a stationary contact assembly has been assembled on the supporting member 14.

The stationary contact assembly is separably engaged by a movable contact assembly movably disposed within the envelope 10 on the longitudinal axis.

The movable contact assembly includes a movable contact member 24 in the form of a hollow cylinder movably disposed within the envelope on the longitudinal axis and having one end portion, in this case, the left-hand end portion as viewed in FIG. 1, separably engaged by the main stationary contact member 16. The movable contact member 24 is provided at the lefthand end with an arc-proof cylindrical piece 26 and at the other or right-hand end with an electrically insulating rod 28, in this case in the form of a hollow cylinder. The electrically insulating rod 28 is disposed within the envelope 10 on the longitudinal axis and connected at the right-hand end thereof to a switching link 30 disposed within a compartment connected in fluid communication with the right-hand open end of the envelope 10. The switching link 30 is operative to engage and disengage the movable contact member 24 with and from the main and arcing stationary contact members 16 and 18.

Further the movable contact member 24 is axially slidably supported by an electrically conductive member 32 in the form of a hollow cylinder through a finger-shaped contact member 34. The electrically conductive member 32 is coaxial with the movable contact member 24 and connected integrally with a support rod 36 formed of an electrically conductive material extending perpendicularly to the longitudinal axis of the envelope 10 and extended and sealed through another electrically insulating cover 38 hermetically closing a lateral opening disposed on the envelope 10.

The electrically conductive member 32 is provided at both ends with shields 40 similar to the shield 22.

The envelope 10 is filled with a sulfur hexafluoride ($SF_6$) gas.

The operation of the arrangement shown in FIG. 1 will now be described. When the switching link 30 is operated to disengage the movable contact member 24 from the main and arcing stationary contact members 16 and 18 a restruck electric arc 42 is developed across the arc proof piece 26 on the movable contact member 24 and the shield 22 of the stationary contact assembly as shown in FIG. 2 wherein there is illustrated the manner in which the system current is being interrupted.

The restruck electrical arcs 42 are intermittently developed by scores upon each of the opening and closing of the disconnecting switch and, in view of the design of the electrical insulation for disconnecting switches, it is important to reduce damage to the surface of the shield 22 due to the restruck arc 42. In order to reduce such damage, it is effective to cause the electric arc 42 randomly developed on the shield 22 to reach a limited area of the shield 22. Doing so is also effective for preventing the restruck electric arcs from progressing to a short circuit-to-ground fault as reported, for example, by S. Narimatsu et al in "Interrupting Performance of Capacity Current by Disconnecting Switch for Gas Insulated Switchgear", IEEE PES 81WM144-5 (1981).

Figure 2:
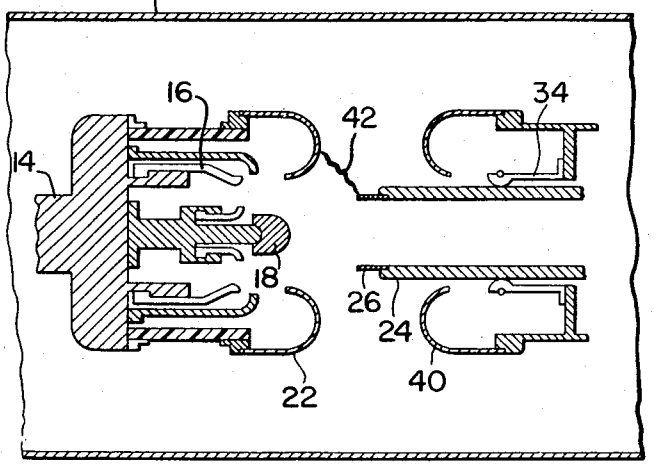
FIG. 2. (PRIOR ART)
FIG. 2 is a fragmental longitudinal sectional view of the arrangement shown in FIG. 1 and illustrated at a transition from its closed to its open position.
Figure 3:
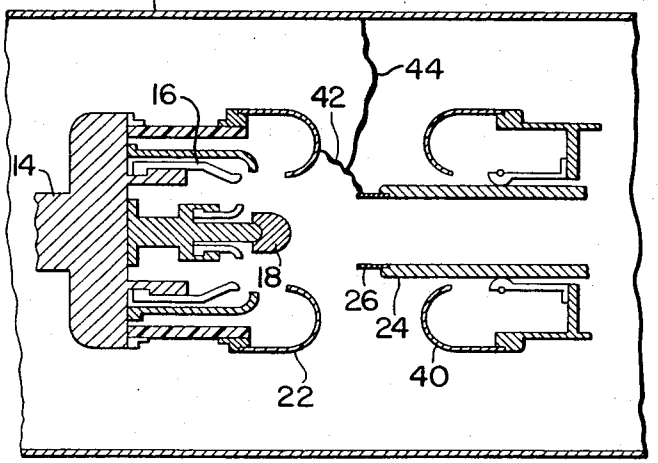
FIG. 3. (PRIOR ART)
FIG. 3 is a view similar to FIG. 2 but useful in explaining the manner in which the restruck electric arc shown in FIG. 2 progresses to a ground fault.

FIG. 3 is a replica FIG. 2 additionally illustrating an electric arc 44 for a short circuit-to-ground fault having progressed from the restruck electric arc and useful in explaining the manner in which the restruck electric arc 42 progresses to the short circuit-to-ground fault. It is considered that the progress to the electric arc 44 results from the fact that an electric field established adjacent to the stationary and movable contact members and the associated components is disturbed with the electric arc 42 bridging the stationary and movable sides. In order to prevent that distrubance, it is effective to concentrate points which the electric arcs 42 reach on the shield 22 to a limited area of the latter.

Figure 4:
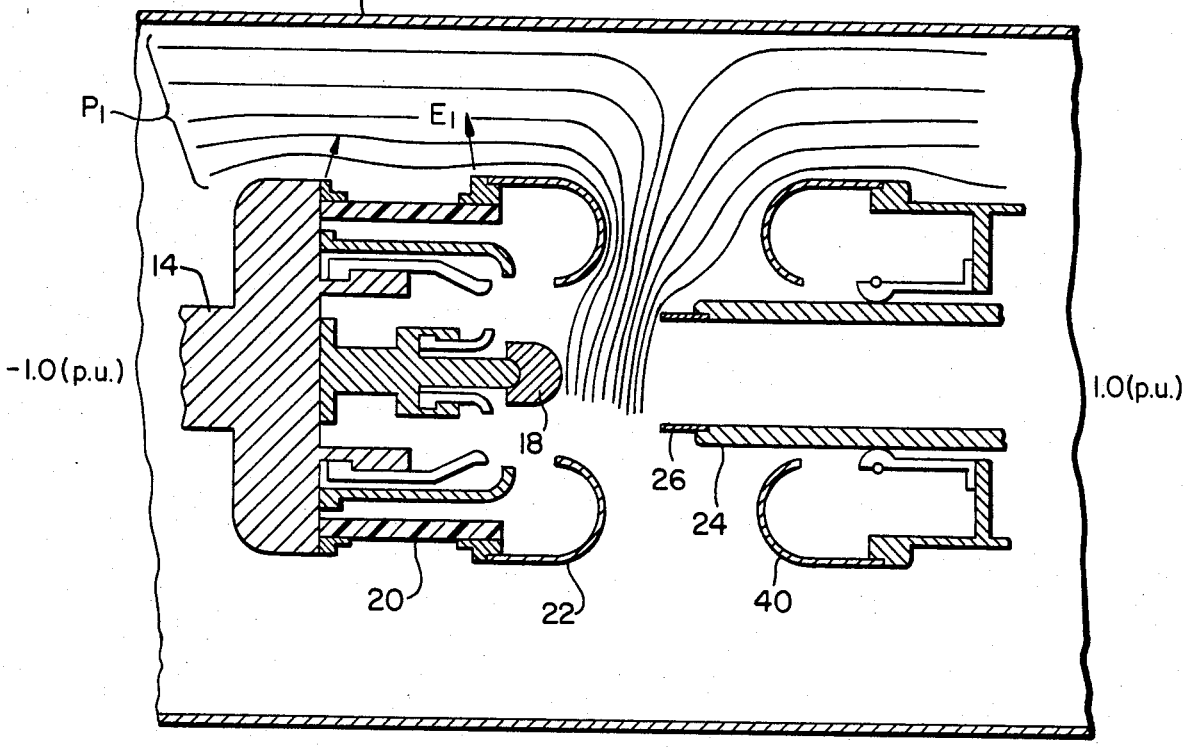
FIG. 4. (PRIOR ART)
FIG. 4 is a view similar to FIG. 2 but illustrating an electric field established adjacent to the stationary and movable contact members shown in FIG. 1 or 2, and before the restruck electric arc occurs.

FIG. 4 shows equipotential lines $P_1$ indicating an electric field established adjacent to the hollow cylindrical member 20 formed of the electrically resisting material within the arrangement of FIG. 1 by the movable contact assembly put at a potential of 1.0 p.u and the stationary contact assembly put at a potential of −1.0 p.u. and immediately before the electric arc 42 restrikes across the arc proof piece 26 and the shield 22 as shown in FIG. 2. (1 p.u. represents the peak value of a normal voltage to ground which is about 450 KV to ground for a 550 KV system.). In FIG. 4 the arrow $E_1$ running from that end portion of the hollow cylindrical member 20 near the shield 22 designates a vector indicating an electric field intensity at that end portion and the other arrow extending from the other end thereof adjacent to the support member 14 designates a vector indicating an electric field intensity on the other end.

Figure 5:
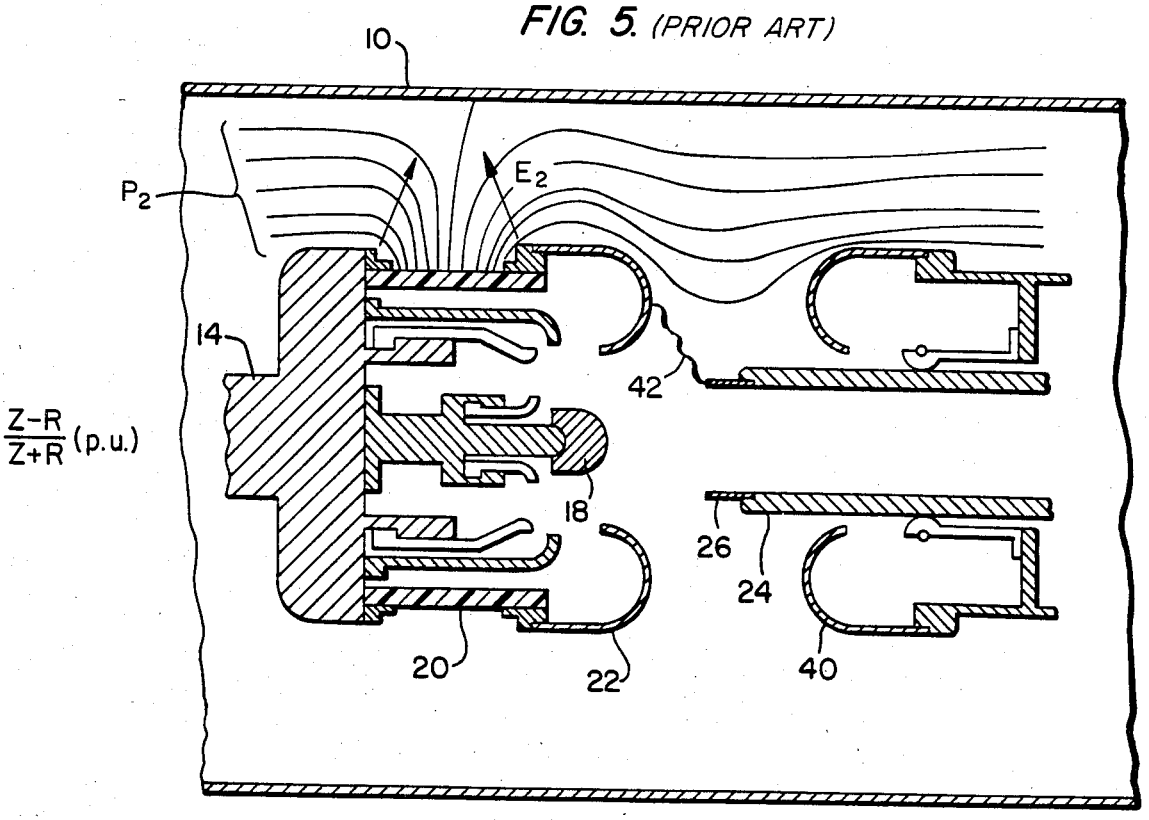
FIG. 5. (PRIOR ART)
FIG. 5 is a similar view to FIG. 4 but illustrating an electric field established immediately after the occurrence of the restruck electric arc shown in FIG. 2.

When the restruck electric arc 42 is caused across the arc proof piece 26 and the shield 22, the equipotential lines $P_1$ and the vectors are immediately charged to equipotential lines $P_2$ and vectors one of which is designated by $E_2$ as shown in FIG. 5. In the arrangement of FIG. 5, the arc resisting piece 26 and the shield 40 on the movable side and the shield 22 on the stationary side are bridged by the restruck arc 42 and substantially instantaneously equal in potential to each other. It is now assumed that Z designates a surge impedance of a bus bar (not shown) connected to the support member 14, R designates a magnitude of resistance of the hollow cylindrical member 20, and a potential difference between the stationary and movable assemblies is 20 p.u. Under the assumed conditions, the potential difference $V_p$ may be expressed by $$V_p = 2.0 \times \frac{R}{Z + R} \text{ in p.u.} \quad (1)$$

immediately after the occurrence of the restruck arc. Thus the support member 14 has a potential expressed by $$1 - V_p = \frac{Z - R}{Z + R} \text{ in p.u.} \quad (2)$$

The surge impedance Z of the bus bar is much smaller than the magnitude of resistance R of the hollow cylindrical member 20 of the electrically resisting material which is provided on the arrangement of FIG. 1 for the purpose of suppressing the surge. Thus, it is seen from the expressions (1) and (2) that, immediately after the electric arc 42 has restruck in the arrangement as shown in FIG. 4, the potential at shield 22 is reversed in polarity from that at the support member 14.

It is noted that the vector $E_2$ shown in FIG. 5 has a magnitude extremely large as compared with the vector $E_1$ shown in FIG. 4.

From the comparison of FIG. 4 with FIG. 5 it is apparent that, in the disconnecting switch including the hollow cylindrical member or resistor 20 disposed outside of the main stationary contact member 16 as shown in FIG. 1, the electric field established adjacent to that resistor 20 abruptly changes after the restrike of the electric arc as compared with that before the restrike of the electric arc, resulting in a rapid increase in intensity of the electric field from the shield 22 or the support member 14 toward the envelope 10. As a result, the disconnecting switch has lost in the electrical insulation-to-ground performance which is the primary function thereof. Thus short circuit-to-ground fault may progress with a high probability.

Figure 6:
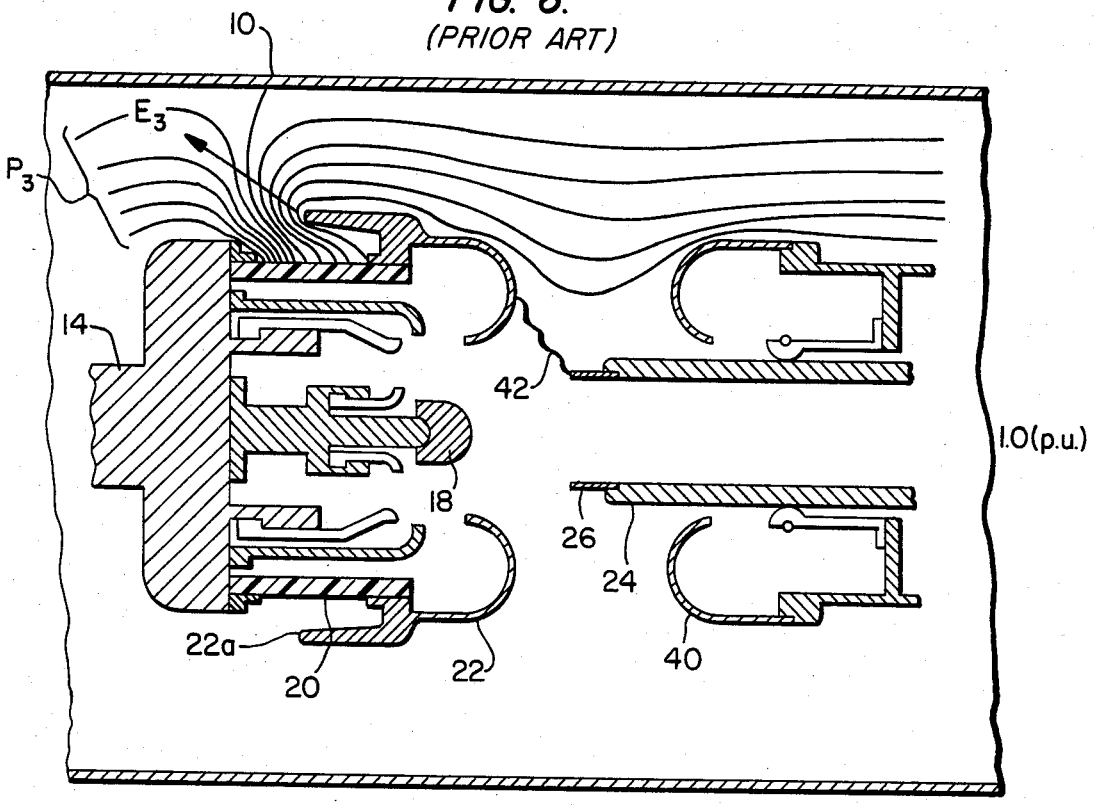
FIG. 6. (PRIOR ART)
FIG. 6 is a view similar to FIG. 5 but illustrating another conventional disconnecting switch.

In order to reduce the electric field intensity $E_2$ shown in FIG. 5, there has been already proposed the arrangement illustrated in FIG. 6 wherein like reference numerals designate the components identical to those shown in FIG. 1. The arrangement illustrated is different from that shown in FIG. 1 only in that in FIG. 6, a cylindrical covering **22*a* is pendent from that end of the shield 22 connected to the hollow cylindrical member 20 to cover about one half the cylindrical member 20 with a space left therebetween. The covering 22*a* serves to reduce the electric field $E_2$ as shown in FIG. 5, but it has been objectionable in that there developes an increase in electric field intensity $E_3$ at the extremity thereof with an associated electric field indicated by equipotential lines $P_3$. In order to avoid this objection the covering 22*a* can be increased in radius of curvature. This increase in radius of curvature has required an increase in inside diameter of the envelope in order to ensure an electrical insulation distance to ground. Thus the arrangement of FIG. 6** is economically disadvantageous.

Figure 7:
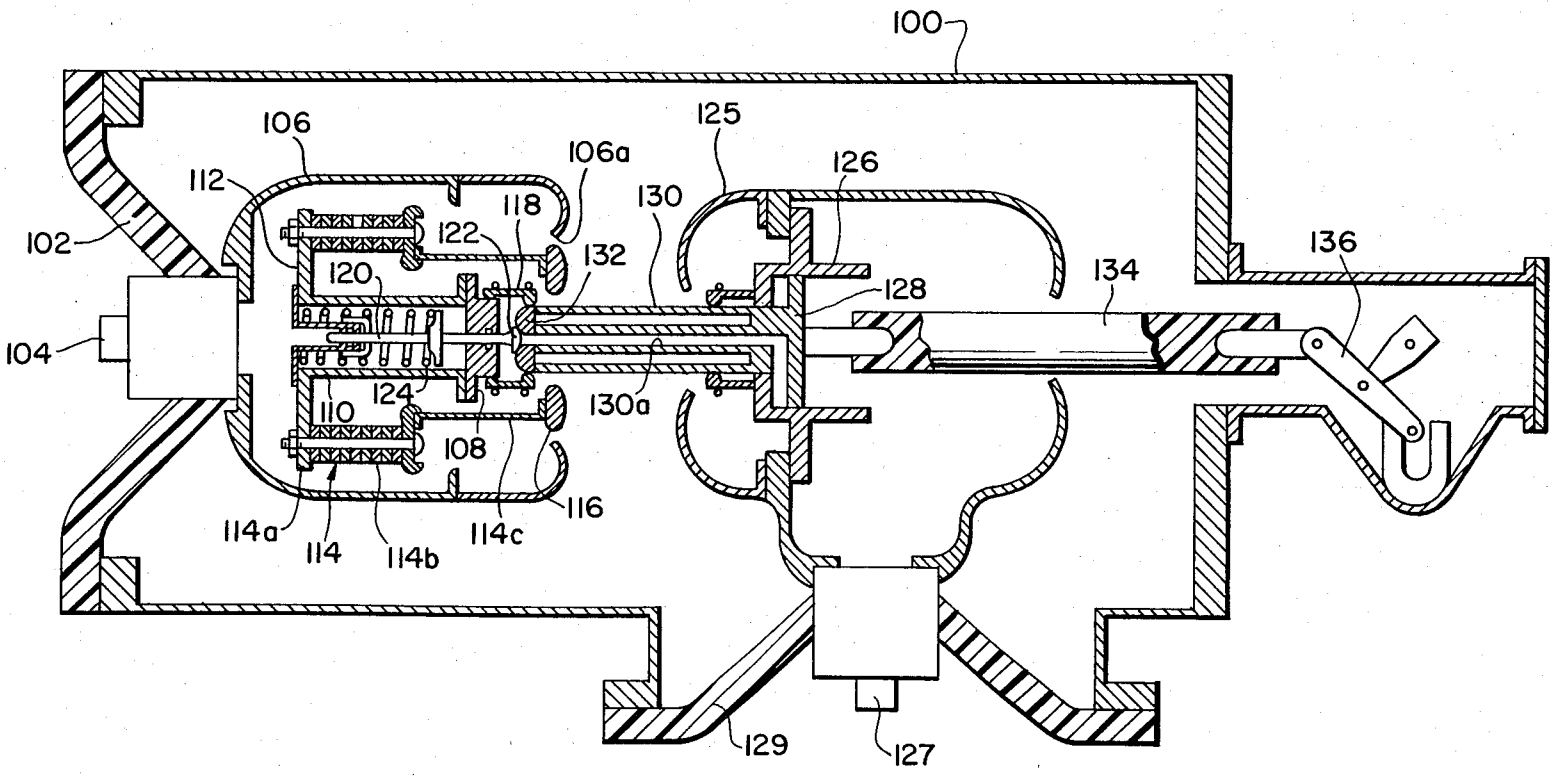
FIG. 7 is a longitudinal sectional view of one embodiment according to the disconnecting switch of the present invention put in its closed position with parts illustrated in elevation.

In FIG. 7, there is illustrated one embodiment according to the disconnecting switch of the present invention. The arrangement illustrated comprises an envelope 100 in the form of a hollow metallic cylinder having one end, in this case, the left-hand end as viewed in FIG. 7 open and closed with an electrically insulating cover 102, an electrically conducting member 104 as a support member centrally extended and sealed through the electrically insulating cover 102 and an electrically conducting shield 106, in the form of a hollow cylinder, disposed within the envelope 100 to be coaxial with the longitudinal axis thereof. The shield 106 is formed with one portion, in this case, a left-hand portion, connected at the left-hand end as viewed in FIG. 7 to the electrically conducting member 104 and another portion (right-hand portion) fixed at the left-hand end thereof as viewed in FIG. 7 to a radially inward directed flange of the right-hand end of the left-hand portion, the right-hand portion being in the shape of a semi-toroid having a curved surface protruding away from the main body of the shield 106 and defining a circular opening **106*a***.

Figure 8:
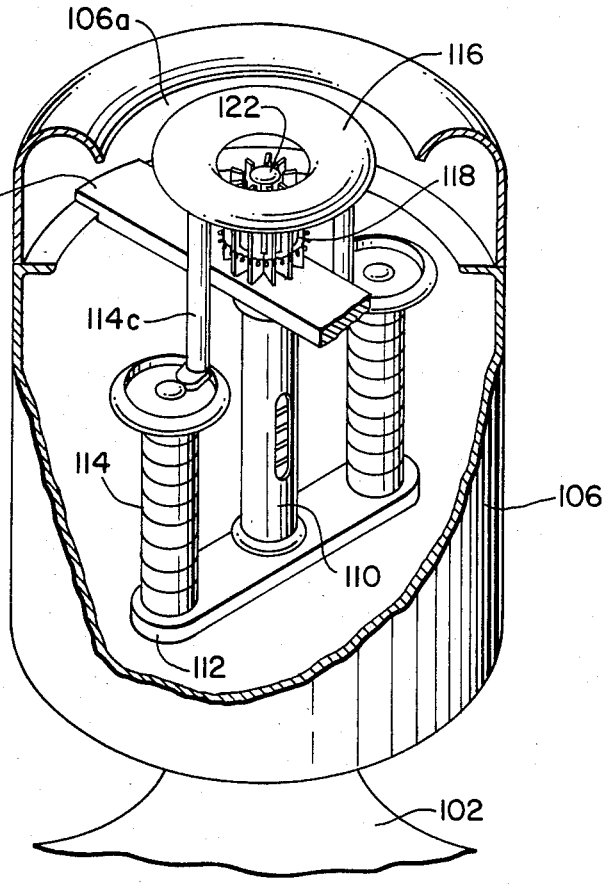
FIG. 8 is a perspective view of the stationary contact side of the arrangement shown in FIG. 8 with parts cut away.

An electrically conducting member 108 in the form of a strip is electrically connected to the flange of the shield by having both ends thereof connected to the flange (see FIG. 8). The electrically conducting member 108 is perpendicular to the longitudinal axis of the envelope 100 and connected at the central portion thereof to an electrically conducting spring casing 110 in the form of a hollow cylinder extending along the longitudinal axis of the envelope 100 and including that end remote from the electrically conducting member 108, in this case, the left-hand end as viewed in FIG. 7. The spring casing 110 is connected at the left-hand end to an electrically conducting strip 112 directed perpendicularly thereto and parallel to the electrically conducting member 108. Then a pair of resistors 114 is disposed at the respective ends of the electrically conducting strip 112 to be parallel to the longitudinal axis of the envelope 100 (see FIGS. 7 and 8). Each of the resistors is formed of a stack of superposed resistor elements 114*a* in the form of discs having an electrically insulating rod 114*b* extending therethrough to connect the resistor elements 114*a* together into a unitary structure with a metallic end disc. Then the pair of resistors 114 is connected via a pair of metallic support rods 114*c* to a toroidal electrode 116 having a generally half circular cross section perpendicular its minor axis, disposed within the opening 106*a* of the shield 106 to be substantially equal at the level to the reentrant peripheral end of the shield. The electrode 116 may be called hereinafter a "resistive electrode".

The electrically conducting member 108 is provided on that surface remote from the spring casing 110 with a raised portion in the form of a solid cylinder and a plurality of electrically conducting strips 118 are radially disposed at equal angular intervals around the raised portion of the electrically conducting member 108 by having those end portions thereof fixed to the latter. Thus the plurality of strips 118 form a main stationary contact member connected to the electrically conducting member 108. The main stationary contact member is also designated by the reference numeral 118.

Also, an electrically conducting support rod 120 movably extends through the central portions of the electrically conducting member 108 and the spring casing 110 to lie on the longitudinal axis of the envelope 100 and is provided at the righthand end as viewed in FIG. 7 with an arcing stationary contact member 122 in the form of a segment of a sphere formed of an arc resisting material. The arcing stationary contact member 122 is electrically connected to the shield 106 through the support rod 120, the spring casing 110 and the electrically conducting member 108.

Figure 11:
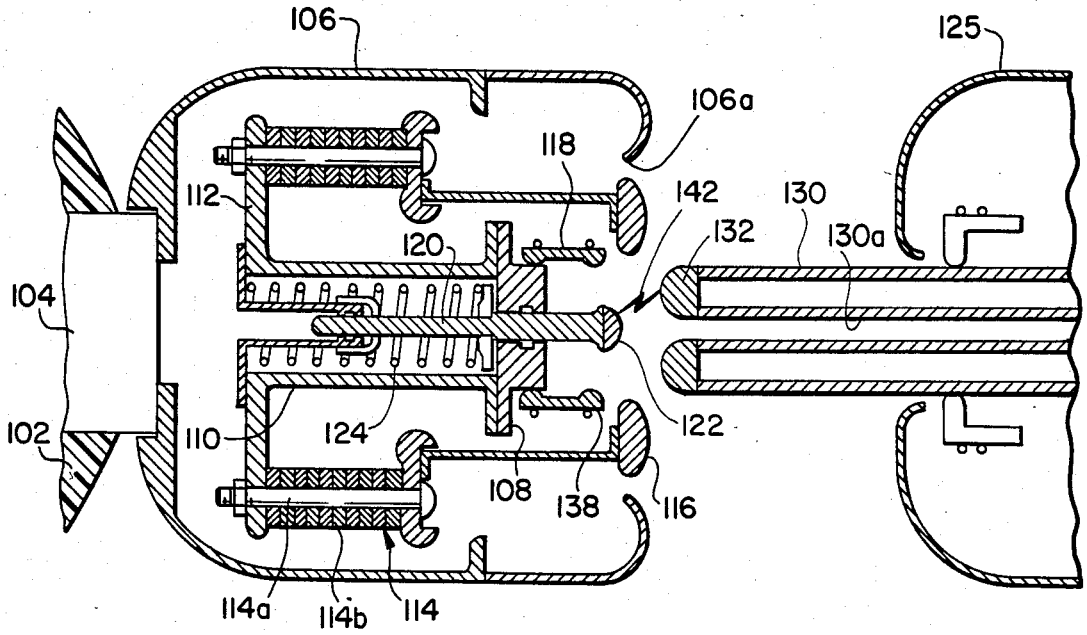

Then a helical spring 124 is disposed within the spring casing 110 between the lefthand end thereof and a spring retainer connected to the support rod 120 to tend to normally push the arcing stationary contact member 122 toward the opening 106*a* of the shield 106. At the open position such as shown in FIG. 11, the spring retainer abuts against the electrically conducting member 108 to locate the arcing stationary contact member 122 slightly above the free end of the main stationary contact member 118 and substantially in the plane defined by the circular opening 106*a* of the shield 106.

As shown in FIG. 7, an electrically conducting shield 125 is disposed on the right-hand half as viewed in FIG. 7 of the envelope 100 by having the lower end thereof as viewed in FIG. 7 connected to an electrically conducting member 127 centrally extended and sealed through an electrically insulating cover 129 which hermetically closes the lateral opening on the envelope 100. The shield 125 is formed of a pair of shield portions connected to each other by having a pair of radially inward directed flanges disposed at the adjacent ends thereof to be perpendicular to the longitudinal axis of the envelope 100 and fixed to each other. The shield 125 includes a pair of opposite openings concentric with the longitudinal axis of the envelope 100. A cylinder 126 of an electrically conducting material is connected to the interconnected flanges of the shield 125 through a radially outward flange and includes a piston 128 slidably disposed in the cylinder 126 to be coaxial with the longitudinal axis of the envelope 100. The piston 128 is formed of an electrically conducting material and is connected to a main movable contact member 130 which extends along the longitudinal axis of the envelope 100 toward the main stationary contact member 118, and includes an arcing movable contact member 132 in the form of an annulus disposed at the extremity thereof. The main movable contact member 130 includes a flow guide 130*a* communicating with the interior of the cylinder 126.

The piston 128 is connected to an operating rod 134 of an electrically insulating material extending on the longitudinal axis of the envelope 100 to be remote from the same and then connected to a driving source (not shown) through a linkage 136 disposed on a driving compartment disposed at the other end of the envelope 100 to communicate with the interior thereof.

Also the envelope 100 is filled with an arc extinguishing gas, for example, gaseous sulfur hexafluoride ($SF_6$).

Figure 9:
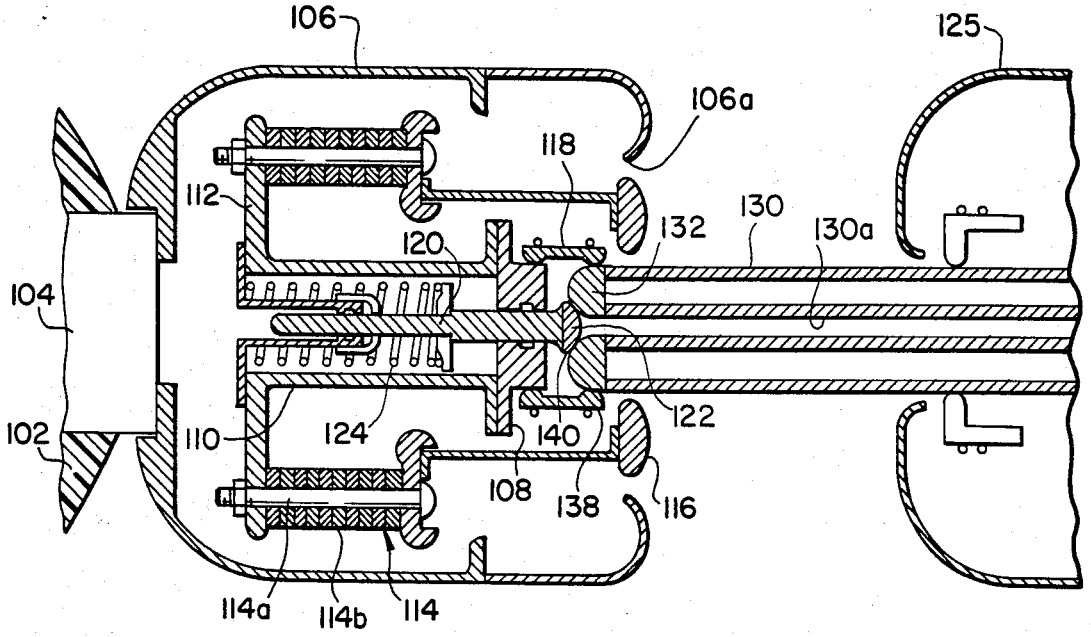
FIG. 9 is a fragmental longitudinal sectional view of one part of the arrangement shown in FIG. 8 and put in its closed position with parts illustrated in elevation.
Figure 10:
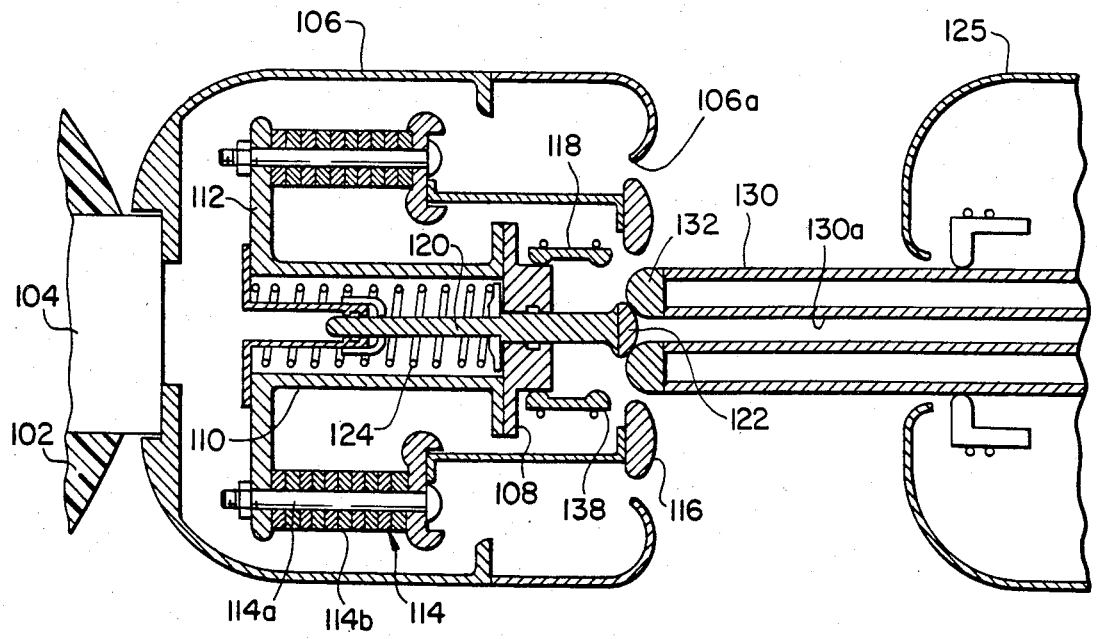
FIGS. 10 through 12 are views similar to FIG. 9 but illustrating the successive positions of the movable contact member relative to the stationary contact members after the arrangement of FIG. 7 has been initiated to perform the opening operation until it reaches its fully open position.

As shown in FIGS. 7 and 10, the main movable contact member 130 is arranged to engage the main stationary contact member 118 to form a pair of contacting main contacts 138 (see FIG. 9) while the arcing movable contact member 132 is arranged to engage the arcing movable contact member 122 to form a pair of contacting arcing contacts 140 (see FIG. 9). The pair of arcing contacts 140 are arranged to be in their open position after the disengagement of the pair of main contacts 138 from each other.

The operation of the arrangement shown in FIG. 7 will now be described. In FIG. 7 the arcing movable contact member 132 is shown as being engaged on the annular end by the arcing stationary contact member 122 and on that portion of the periphery thereof adjacent to the movable contact member 130 by the inside of the main stationary contact member 118 with the spring 124 in its compressed state. When a loop current as described above is interrupted by the arrangement of FIG. 7, the electrically insulating rod 134 is moved in a righthand direction as viewed in FIG. 7 through the operation of the linkage 136 to disengage the main movable contact member 130 from the main stationary contact member 118. This results in the right-hand movement of the main stationary contact member 118 by means of the action of the spring 124. Thus the movable and stationary contact members 118 and 130 respectively occupy the positions shown in FIG. 10. At that time a pressure within the cylinder 126 is reduced to cause a pressure difference between the envelope 100 and the cylinder 126.

During a further right-hand movement of the main movable contact member 130, the arcing movable contact member 132 is initiated to disengage from the arcing stationary contact member 122 to cause the loop current to strike an electric arc 142 across the contact members 132 and 122 as shown in FIG. 11. That electric arc 142 can be extinguished through the utilization of a gas stream due to the pressure difference between the envelope 100 and the cylinder 126.

Figure 12:
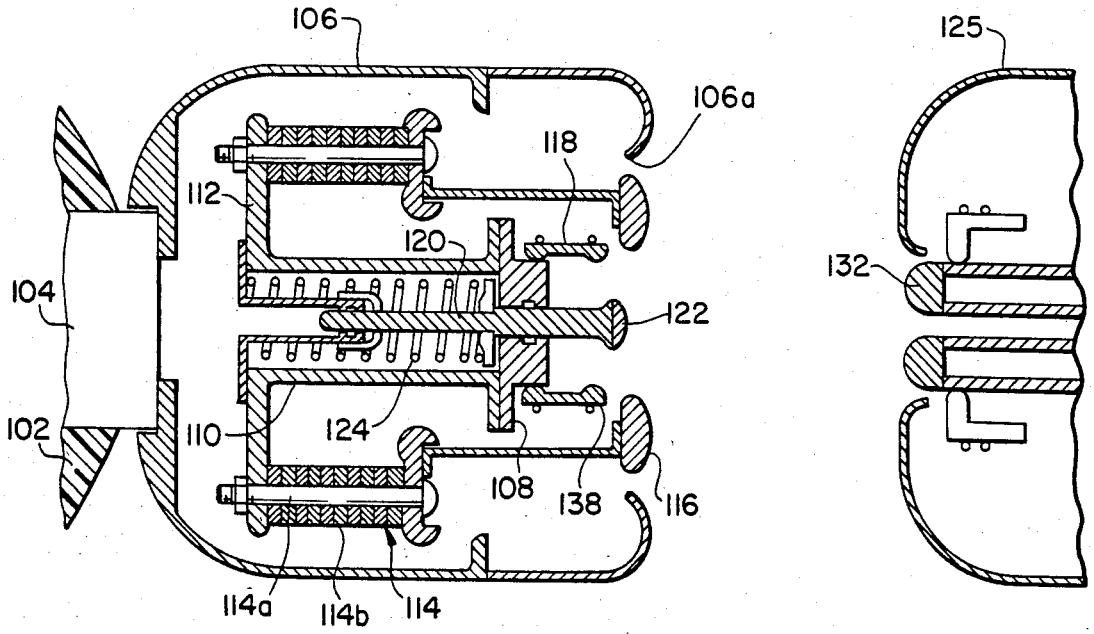

The main movable contact member 130 continues to be further moved in the right-hand direction. Since a recovery voltage generated upon interrupting the loop current is normally on the order or a few hundred volts, an electric arc does not restrike after the interruption of the loop current and the movable contact member 130 ultimately reaches its position as shown in FIG. 12 resulting in the completion of the interruption operation.

Figure 13:
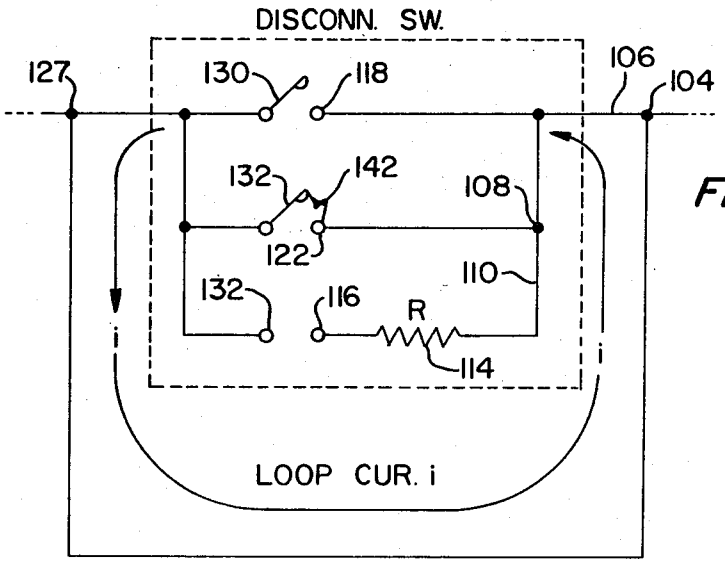
FIG. 13 is an equivalent circuit to the arrangement of FIG. 8 upon the interruption of a loop circuit.

FIG. 13 shows an equivalent circuit illustrating the state in which the loop current is interrupted. The arrangement illustrated comprises the disconnecting switch expressed by a parallel combination of a current path including the main movable contact member 130, the main stationary contact member 118 and a gap between the contact members 130 and 118, a current path including the arcing movable contact member 32, the arcing stationary contact member 122, the electric arc 142 struck across the contact members 132 and 122, and the electrically conducting member 108, and a current path including the arcing movable contact member 132, the resistive electrode 114 having a magnitude of resistance R, the electrode 116, a gas formed between the contact member 32 and the electrode 116, the parallel resistor 114 and the spring casing 110. The parallel combination is connected at one end to the electrically conducting member 127 and at the other end to the electrically conducting member 104 through the shield 106. Furthermore, the electrically conducting member 127 is connected to the electrically conducting member 104 through a current path along which the loop current i flows from the member 127 to the member 104.

From FIG. 13 it is seen that, upon interrupting the loop current, the current path passes through the arcing contact members 122 and 132 alone.

The opening of an electric line under non-loading conditions will now be described. The operation of the disconnecting switch itself is, as a matter of course, identical during the interruption of the loop current and during the opening of the non-loaded line, but the phenomena developed in the process of disengaging the movable contact members from the stationary contact members are different.

As described above, the electrically insulating operating rod 134 is moved in the righthand direction to first disengage the main movable contact member 130 from the main stationary contact member 118 and then disengage the arcing movable contact member 132 from the arcing stationary contact member 122. At that time a potential difference is developed across the arcing contact members 122 and 132 because an associated electric source (not shown) varies at a commercial frequency. As a result, an electric arc restrikes across those contact members 122 and 132.

The restruck electric arc causes a surge generally having an extremely large amplitude increase which is an increase by a factor in the range 1.7 to 1.9. Such a surge is generally proportional to a potential difference between the contact members upon the restrike of the electric arc. The potential difference is also proportional to a distance between the contact members. Thus a surge required to be suppressed through the insertion of a resistance is limited to what is caused at a position where the main movable contact member 130 is spaced from the arcing stationary contact member 122 by a certain distance. This distance is dependent upon the type of the device and is not less than about one quarter to about one third of a maximum distance by which the main movable contact member 130 can be spaced from the arcing stationary contact member 122 at its fully open position.

Accordingly, a surge due to an electric arc restruck across the main movable contact member 130 and the arcing stationary contact member 122 is not required to be suppressed through the insertion of the resistance. When the main movable contact member 130 reaches its position shown in FIG. 14, which position is spaced from the arcing stationary contact member 122 by a distance equal to about one third to about one half the maximum distance as described above, an electric arc 144 restrikes across the arcing movable contact member 132 and the resistive electrode 116. The restruck electric arc 144 may cause a potential difference between the contact member 132 and the resistive electrode 116 to amount to 2 p.u. which figure is equal to twice the peak value of a normal voltage to ground. Thus a surge due to that restruck arc is extremely large. Accordingly, it is required to serially insert a resistance into circuit with the disconnecting switch to suppress the surge.

However, the arcing stationary contact member 122 is located without the shield 106 to be remote from the plane of the opening **106*a* on the shield 106 as compared with the toroidal resistive electrode 116 and a gap is formed between the opening 106*a* on the shield 106 and the resistive electrode 116. Under these circumstances, all electric arcs are permitted to restrike across arcing movable contact member 132 and the resistive electrode 116. Furthermore, due to the gap formed between the opening 106*a* and the resistive electrode 116, the restruck electrode arc can be moved within a range limited to the surface portion of the resistive electrode 116 facing the arcing movable contact member 132 without the arc shield to the shield 106. This means that the restruck electric arc scarcely disturbs a potential distribution established adjacent to the shield 106 and 125**. Therefore the probability that the restruck electric arc will progress to a short circuit-to-ground fault is extremely small.

Figure 14:
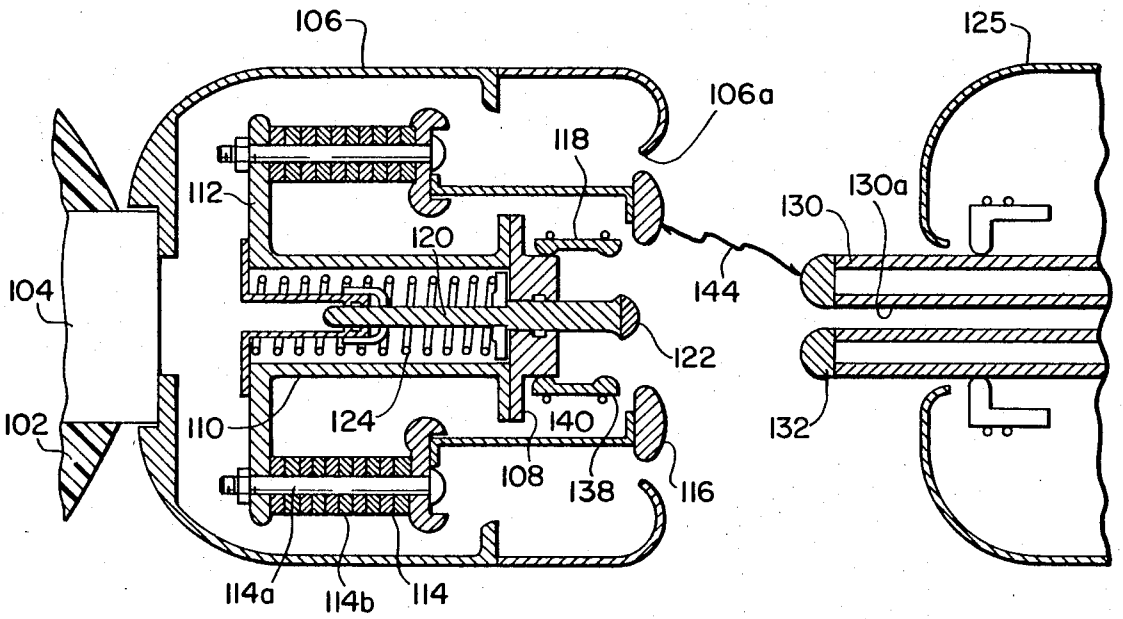
FIG. 14 is a view similar to FIG. 11 or 12 but illustrating the position of the movable contact member relative to the stationary contact members shortly before reaching the fully open position thereof.
Figure 15:
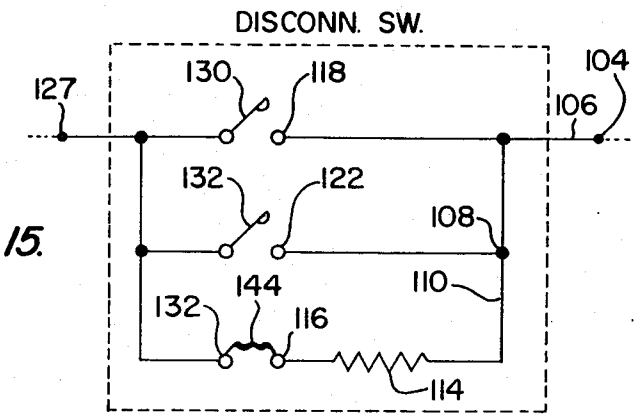
FIG. 15 is an equivalent circuit to the arrangement of FIG. 8 upon opening an electric line under non-loading conditions.

FIG. 15 shows an equivalent circuit illustrating the status of the electric arc restruck upon opening the non-loaded line as shown in FIG. 14. The arrangement illustrated is different from that shown in FIG. 13 only in that in FIG. 15 the electric arc 144 restrikes across the arcing movable contact member 132 and the resistive electrode 116 without the electric arc 142 restruck across the arcing contact members 132 and 122 with the current path for directly connecting the electrically conducting members 127 and 104 to each other omitted. From FIG. 15 it is seen that, with the main movable contact member 132 located at its position shown in FIG. 14, the resistors 114 suppress a harmful surge developed across the electrically conducting members 104 and 127. This is because all surges due to the restruck electric arc pass through the resistors 114.

At that time the potential difference $V_p$ expressed by the expression (1) above, is developed across each the resistors 114. Thus suitable electrically insulating distances are required to be provided between the resistive electrode 116 and the shield 106 and between each of the support rods **114*c* and the electrically conducting member 108**.

However the potential difference $V_p$ is developed across each resistor 114 in the process of consuming energy of the surge. Assuming that the electric insulation is broken in a space disposed between the shield 106 and one end of one of the resistors 114, the voltages across the resistors 114 are only equal to each other but the potential distribution between the shield 106 and the envelope 100 is not changed. Thus, the disconnecting switch of the present invention retains the electrical insulation-to-ground performance which is the primary function thereof and is not substantially impeded.

After the main movable contact member 130 has been spaced to an electrically insulating distance capable of sufficiently withstanding a potential difference of, for example, 2 p.u. which can be developed across the contact members 118 and 130, the restruck electric arc disappears. Thereafter the main movable contact member 130 is further moved to its fully open position as shown in FIG. 12.

From the foregoing it is seen that the present invention comprises a resistive electrode independently disposed within a shield, and a resistor disposed in the interior of the shield. The measure prevents the electrical insulation-to-ground performance from being impeded upon the interruption. Also when the resistive electrode is formed of an arc resisting metal for example, a copper-tungsten alloy or carbon, damage thereto is suppressed damage and stationary and movable contact members are improved in their ability to withstand voltage therebetween.

While the present invention has been illustrated and described in conjunction with a single preferred embodiment thereof it is to be understood that numerous changes and modifications may be resorted to without departing from the spirit and scope of the present invention.

What is claimed is:

1. A disconnecting switch, comprising:

an electrically conductive member;

an electrically conductive shield having a circular opening therein;

a main contact and an arcing contact within said shield electrically connected to said electrically conductive member;

a movable contact member insertable through said opening into said shield into physical and electrical contact with each of said main contact and said arcing contact inside said shield and retractable out of said shield through said opening so as to separate from said main contact before separating from said arcing contact;

a resistive electrode in the shape of a toroid, disposed between a portion of said shield defining said circular opening and said movable contact member, said toroid having a curved surface externally protruding beyond said opening; and a resistor inside said shield connecting said resistive electrode to said electrically conductive member, so as to define a first current path from said movable contact member across a first gap between said movable contact member and said resistive electrode and through said resistive electrode and said resistor, said first path being electrically in parallel to a second current path across a second gap between said movable contact member and said arcing contact upon disengagement of said movable contact member from said arcing contact.

2. A disconnecting switch as claimed in claim 1, further comprising a plurality of support rods electrically connected to said resistor and supporting said resistive electrode.

3. A disconnecting switch as in claim 2, wherein said arcing and main contacts are electrically connected to said shield, said resistive electrode being electrically connected to said shield through said resistor, said arcing contact being spring mounted within said shield so as to maintain electrical contact with said movable contact member along a segment of retraction of said movable contact member from said shield.

* * * * *